US005080577A

United States Patent [19]

Bell et al.

[11] Patent Number: 5,080,577

[45] Date of Patent: Jan. 14, 1992

[54] COMBUSTION METHOD AND APPARATUS FOR STAGED COMBUSTION WITHIN POROUS MATRIX ELEMENTS

[76] Inventors: Ronald D. Bell, 10608 Zeus Cove, Austin, Tex. 78759; William C. Gardiner, 2612 Marie Anna Rd.; John R. Howell, 3200 Kerbey La., both of Austin, Tex. 78703; Ronald D. Matthews, 4508 Sinclair, Austin, Tex. 78756; Steven P. Nichols, 2116 Glendale Pl., Austin, Tex. 78704

[21] Appl. No.: 708,090

[22] Filed: May 24, 1991

Related U.S. Application Data

[63] Continuation-in-part of Ser. No. 554,748, Jul. 18, 1990, abandoned.

[51] Int. Cl.[5] ..... F23D 3/40

[52] U.S. Cl. ..... 431/7; 431/10; 431/328

[58] Field of Search ..... 431/7, 10, 170, 328, 431/329; 126/92 AC, 91 R; 60/39.06, 723

[56] References Cited

U.S. PATENT DOCUMENTS

| | | | |
|---|---|---|---|
| 3,322,179 | 5/1967 | Goodell | 431/328 |
| 3,810,732 | 5/1974 | Koch | 431/7 |
| 3,846,979 | 11/1974 | Pfefferle | 60/39.04 |
| 4,087,962 | 5/1978 | Beremand et al. | 60/39.65 |
| 4,112,676 | 9/1978 | DeCorso | 431/10 |
| 4,285,193 | 8/1981 | Shaw et al. | 60/39.06 |
| 4,405,587 | 9/1983 | McGill et al. | 431/10 |
| 4,459,126 | 7/1984 | Krill | 431/7 |
| 4,517,798 | 5/1985 | Roberts | 60/723 |
| 4,534,165 | 8/1985 | Davis, Jr., et al. | 60/39.02 |
| 4,569,328 | 2/1986 | Shukla et al. | 431/328 |
| 4,643,667 | 2/1987 | Fleming | 431/7 |
| 4,709,643 | 12/1987 | Moreno et al. | 60/752 |
| 4,726,181 | 2/1988 | Pillsbury | 431/7 |
| 4,730,599 | 3/1988 | Kendall et al. | 431/7 |
| 4,731,989 | 3/1988 | Furuya et al. | 431/7 |
| 4,787,208 | 11/1988 | DeCorso | 60/723 |
| 4,800,866 | 1/1989 | Finke | 126/91 A |
| 4,811,555 | 3/1989 | Bell | 60/39.06 |

FOREIGN PATENT DOCUMENTS

| | | | |
|---|---|---|---|
| 1393994 | 5/1988 | U.S.S.R. | 431/7 |

OTHER PUBLICATIONS

"The Effect of Radiation on the Structure of Premixed Flames Within a Highly Porous Inert Medium." Y-K Chen et al., *Radiation, Phase Change, Heat Transfer, and Thermal Systems*, ed. by Y. Jaluria, et al., ASME Publication HTD, vol. 81, 1987.

"Premixed Combustion in Porous Inert Media." Y-K Chen et al., Proceedings of the Joint Meeting of the Japanese and Western States Sections of the Combustion Institute, pp. 266-268, 1987.

"Experimental and Theoretical Investigation of Combustion in Porous Inert Media," Y-K Chen et al., Paper PS-201, *Twenty-Second Symposium (International) on Combustion*, 1988.

*Primary Examiner*—James C. Yeung

*Attorney, Agent, or Firm*—Klauber & Jackson

[57] ABSTRACT

Low $NO_x$ combustion is effected by a method wherein a fuel, e.g., natural gas, and a source of oxygen, e.g., air, are mixed and the mixture is combusted in at least two successive combustion zones filled with a porous matrix, the void spaces of which provide sites at which substantially all of the said combustion occurs; viz. a first zone wherein the mixture is fuel-rich, and a second zone wherein the mixture is fuel-lean. Preferably, the method utilizes an additional combustion zone which precedes or is upstream of the first zone and is filled with a said porous matrix, wherein the mixture is fuel-lean. Apparatus for low $NO_x$ combustion is also provided which includes an arrangement for mixing fuel and oxygen, and at least first and second combustion zones filled with a said porous matrix, and means for providing a fuel-oxygen mixture to said first zone which is fuel rich, and for adjusting the resulting combustion products flowed to the second zone with additional fuel and oxygen as to provide a fuel-lean mixture therein. Preferably the apparatus also includes a zone or stage filled with a said porous matrix which precedes or is upstream of the first zone, to which the fuel and oxygen are initially provided as to establish fuel-lean conditions therein.

15 Claims, 1 Drawing Sheet

COMBUSTION METHOD AND APPARATUS FOR STAGED COMBUSTION WITHIN POROUS MATRIX ELEMENTS

This application is a continuation-in-part, of application Ser. No. 554,748, filed July 18, 1990, abandoned.

FIELD OF THE INVENTION

This invention relates generally to combustion methodology and apparatus, and more specifically relates to an improved combustion method and apparatus which is effective in the reduction of $NO_x$ emissions.

BACKGROUND OF THE INVENTION

Environmental pollution caused by combustion-generated $NO_x$ emissions, is a matter of great concern to the public, and as well to industrial fuel users. Beginning in the 1960's, governmental agencies, indeed prompted by public concern with increasing levels of smog and air pollutants, imposed $NO_x$ reduction requirements upon existing power plants in major metropolitan areas. Industry, accepting the challenge, has already developed a large variety of technologies to meet the new needs. Modifying the combustion process has become the most widely used technology for reducing combustion generated $NO_x$. In addition, a number of flue gas treatment technologies have been developed and are emerging as the primary method of control for certain applications, but have seen limited use where natural gas is the fuel of choice.

Oxides of nitrogen ($NO_x$) are formed in combustion processes as a result of thermal fixation of nitrogen in the combustion air ("thermal $NO_x$"), by the conversion of chemically bound nitrogen in the fuel, or through "prompt-$NO_x$" formation. In addition to generating "thermal $NO_x$", i.e., by high temperature combination of free nitrogen and oxygen, where the fuels employed by such users (e.g. coal gas) contain substantial quantities of chemically bound nitrogen, certain combustion conditions will favor the formation of undesirable NO-type compounds from the fuel-bound nitrogen. "Prompt $NO_x$" refers to oxides of nitrogen that are formed early in the flame and do not result wholly from the Zeldovich mechanism. Prompt-$NO_x$ formation is caused by 1) interaction between certain hydrocarbon components and nitrogen components and/or, 2) an overabundance of oxygen atoms that leads to early $NO_x$ formation. For natural gas firing, virtually all of the $NO_x$ emissions result from thermal fixation, which is commonly referred to as "thermal $NO_x$", or from prompt $NO_x$. The formation rate is strongly temperature dependent and generally occurs at temperatures in excess of 1800° K. (2800° F.) and generally is more favored in the presence of excess oxygen. At these temperatures, the usually stable nitrogen molecule dissociates to form nitrogen atoms which then react with oxygen atoms and hydroxyl radicals to form, primarily, NO.

In general, $NO_x$ formation can be retarded by reducing the concentrations of nitrogen and oxygen atoms at the peak combustion temperature or by reducing the peak combustion temperature and residence time in the combustion zone. This can be accomplished by using combustion modification techniques such as changing the operating conditions, modifying the burner design, or modifying the combustion system.

Of the combustion modifications noted above, burner design modification is most widely used. Low $NO_x$ burners are generally of the diffusion burning type, designed to reduce flame turbulence, delay the mixing of fuel and air, and establish fuel-rich zones where combustion is initiated. Manufacturers have claimed 40 to 50 percent nominal reductions, but significant differences in the predicted $NO_x$ emissions and those actually achieved have been noted. The underlying cause for these discrepancies is due to the complexity in trying to control the simultaneous heat and mass transfer phenomena along with the reaction kinetics for diffusion burning. In addition, it is extremely difficult to obtain representative samples from the flame envelope of this type of burner, which when analyzed, can provide the necessary data to improve predictive models.

Illustrative of the foregoing and related techniques for $NO_x$ reduction, are the disclosures of the following United States patents:

DeCorso, U.S. Pat. No. 4,787,208 discloses a low-$NO_x$ combustor which is provided with a rich, primary burn zone and a lean secondary burn zone. $NO_x$ formation is inhibited in the rich burn zone by an oxygen deficiency, and in the lean burn zone by a low combustion reaction temperature. Ceramic cylinders are used at certain parts of the combustion chambers.

Fanuyo et al, U.S. Pat. No. 4,731,989 describes a combustion method for reducing $NO_x$ emissions, wherein catalytic combustion is followed by non-catalytic thermal combustion.

Davis, Jr. et al, U.S. Pat. No. 4,534,165 seeks to minimize $NO_x$ emissions by providing operation with a plurality of catalytic combustion zones and a downstream single "pilot" zone to which fuel is fed, and controlling the flow of fuel so as to stage the fuel supply.

DeCorso, U.S. Pat. No. 4,112,676 shows a combustor generally of the diffusion burning type for a gas turbine engine.

Pillsbury, U.S. Pat. No. 4,726,181 provides combustion in two catalytic stages in an effort to reduce $NO_x$ levels.

Kendall et al. U.S. Pat. No. 4,730,599 discloses a gas-fire radiant tube heating system which employs heterogeneous catalytic combustion and claims low-$NO_x$ catalytic combustion.

Shaw et al, U.S. Pat. No. 4,285,193 describes a gas turbine combustor which seeks to minimize $NO_x$ formation by use of multiple catalysts in series or by use of a combination of non-catalytic and catalytic combustion.

Pfefferle, U.S. Pat. No. 3,846,979 describes low $NO_x$ emissions in a two-stage combustion process wherein combustion takes place above 3300° F., the effluent is quenched, and the effluent is subjected to catalytic oxidation.

Beremand et al, U.S. Pat. No. 4,087,962, discloses a combustor which utilizes a non-adiabatic flame to provide a low emission combustion for gas turbines. The fuel-air mixture is directed through a porous wall, the other side of which serves as a combustion surface. A radiant heat sink is disposed adjacent to the second surface of the burner so as to remove radiant energy produced by the combustion of the fuel-air mixture, and thereby enable operation below the adiabatic temperature. The inventors state that the combustor operates near the stoichiometric mixture ratio, but at a temperature low enough to avoid excessive $NO_x$ emissions. In one embodiment the radiant heat sink comprises a further porous plate.

In U.S. Pat. No. 4,811,555, of which Ronald D. Bell, one of the applicants of the present application, is patentee, there is described a cogeneration system in which $NO_x$ is controlled by the treatment of the turbine exhaust by a combination of combustion in a reducing atmosphere and catalytic oxidation.

In McGill et al, U.S. Pat. No. 4,405,587, for which Ronald D. Bell is a co-patentee, the $NO_x$ content of a waste stream is controlled by treating it and subjecting it to high-temperature combustion in combined reducing and oxidation zones.

Recent work by several of the present co-inventors and others, has resulted in a combustion device which utilizes a highly porous inert media matrix to provide for containment of the combustion reaction within the porous matrix—which may comprise fibers, beads, or other material which has a high porosity and a high melting temperature. Preferably, a ceramic foam is used. This ceramic, sponge-like material has a porosity (typically about 90%) which provides a flow path for the combustible mixture. The energy release by the gas phase reactions raises the temperature of the gases flowing through the porous matrix in the post-flame zone. In turn, this convectively heats the porous matrix in the post-flame zone. Because of the high emissivity of the solid in comparison to a gas, radiation from the high temperature postflame zone serves to heat the preflame zone of the porous material which, in turn, convectively heats the incoming reactants. This heat feedback mechanism results in several interesting characteristics relative to a free-burning flame. These include higher burning rates, higher volumetric energy release rates, and increased flame stability resulting in extension of both the lean and rich flammability limits. In addition to the ability to achieve very high radiant output from a very compact combustor, flame temperature increases are negligible. This is an important consideration with respect to $NO_x$ control purposes.

A one-dimensional mathematical model was constructed that included both radiation and accurate multi-step chemical kinetics. This model was used to predict the flame structure and burning velocity of a premixed flame within an inert, highly porous medium. The various predictions of this model have been discussed by Chen et al. See "The Effect of Radiation on the Structure of Premixed Flames Within a Highly Porous Inert Medium", Y-K Chen, R. D. Matthews, and J. R. Howell; *Radiation, Phase Change, Heat Transfer, and Thermal Systems.* ed. by Y. Jaluria, V. P. Carey, W. A. Fiveland, and W. Yuen (eds.), ASME Publication HTD-Vol. 81, 1987. "Premixed Combustion in Porous Inert Media"; Y-K Chen, R. D. Matthews, J. R. Howell, Z-H Lu, and P. L. Varghese, *Proceedings of the Joint Meeting of the Japanese and Western States Sections of the Combustion Institute,* pp. 266–268, 1987; and "Experimental and Theoretical Investigation of Combustion in Porous Inert Media", Y-K Chen, R. D. Matthews, I-G Lim, Z. Lu, J. R. Howell, and S. P. Nichols Paper PS-201, *Twenty-Second Symposium (International) on Combustion,* 1988. These papers demonstrate that a porous matrix (PM) combustor can provide a number of advantages over diffusion burners. However, these papers are focused on the development of this new concept, but are not concerned with the problem of $NO_x$ emissions, much less with the effective reduction of same.

OBJECTS OF THE INVENTION

In accordance with the foregoing, it may be regarded as an object of the present invention, to provide an improved combustion method, which is effective to reduce $NO_x$ emissions.

It is another object of the invention, to provide an improved combustion method of the foregoing character, which does not require the use of catalysts.

It is a still further object of the present invention, to provide an improved combustion method, employing combustion in a porous matrix, which effectively controls $NO_x$ emissions.

It is a further object of the invention to provide improved combustion apparatus for controlling $NO_x$ emissions.

It is a yet further object of the present invention, to provide combustion apparatus based upon use of a porous matrix, which can be used to replace conventional combustors in numerous applications for which high radiant output, high combustion efficiency, high throughput, lean operation, and/or low emissions of the oxides of nitrogen are sought.

SUMMARY OF THE INVENTION

In accordance with the present invention, low $NO_x$ combustion is effected by a method wherein a fuel, e.g., natural gas, and a source of oxygen, e.g., air, are mixed and the mixture is combusted in at least two successive zones, each filled with a porous high temperature resistant matrix the void spaces of which provide sites at which substantially all of the process combustion occurs; viz., a fuel-rich zone wherein combustion of the mixture occurs under fuel-rich conditions, and a lean burn zone which is downstream of the fuel-rich zone, and which receives the combustion products from the fuel-rich zone together with additional air to complete the oxidation. Preferably, the method utilizes an additional lean burn combustion zone filled with a said porous matrix, which zone precedes, i.e. is upstream of the fuel-rich zone. Thus when there are two zones or stages, a fuel-rich mixture is burned in the first stage, and a lean mixture is burned in the second stage. When there are three successive zones (or stages), a lean mixture is burned in the first stage, a rich mixture is burned in the second stage, and the mixture in the third stage is a lean mixture.

The invention also contemplates the provision of apparatus for low $NO_x$ combustion, comprising first and second combustion zones, each filled with a said porous matrix, and said second zone being downstream of said first zone. Means are provided for mixing fuel and oxygen and providing same to said first combustion zone to establish fuel-rich conditions therein; and means for providing the combustion products from said first zone to said second zone and augmenting same with further fuel and sufficient additional oxygen to create lean burning conditions therein to complete the oxidation of the products from the first zone. In some instances the lean burning conditions of the second stage can be achieved by addition of air or oxidant without supplemental fuel.

In accordance with the invention, heat transfer by convection and radiation within the porous matrix element of the first zone preheats the incoming fuel/air mixture to yield a flame temperature which is higher than the theoretical adiabatic flame temperature for said mixture, thus allowing a broader range of fuel/air mixtures to be combusted under fuel rich conditions, and in which heat transfer by radiation from the non-porous walls of the second stage result in an overall lower-flame temperature for the second zone operating in a lean fuel/air ratio condition, and thus minimizing the formation of thermal $NO_x$.

Preferably the apparatus further includes an additional zone filled with one or more porous matrix elements, which precedes, i.e., is upstream of the first combustion zone; and means to introduce fuel and air to said additional zone to create lean combustion conditions therein. Heat transfer within the first zone porous matrix preheats the incoming fuel lean fuel/air mixture and allows stable combination within minimum residence time at a temperature below 2800° F., to minimize the formation of "prompt" $NO_x$.

The porous matrix can comprise a porous ceramic foam, e.g. a reticulated silica-alumina or zirconia foam, in which case the voids are defined by the pores of the foam. Similarly the said matrix can comprise a packed bed—e.g. of ceramic balls, rods, fibers or other media which can withstand the high temperature of the combustion processes. In these instances the voids are defined by the interspaces among the media. It is important to point out here, that in the present invention, unlike certain prior art methodology, substantially all of the process combustion occurs in the void spaces of the matrix—not at surfaces of a ceramic or porous tube or the like. Also to be noted is that differing matrices can be used at the successive zones—and indeed the matrix at a given zone can comprise combinations of one or more contiguous sections, one of which may e.g. comprise a porous ceramic foam and another a packed bed, or so forth.

BRIEF DESCRIPTION OF THE DRAWINGS

The invention will be more readily apparent from the following detailed description, which should be read in conjunction with the appended drawings, in which.

DETAILED DESCRIPTION OF PREFERRED EMBODIMENTS

Figure 1:
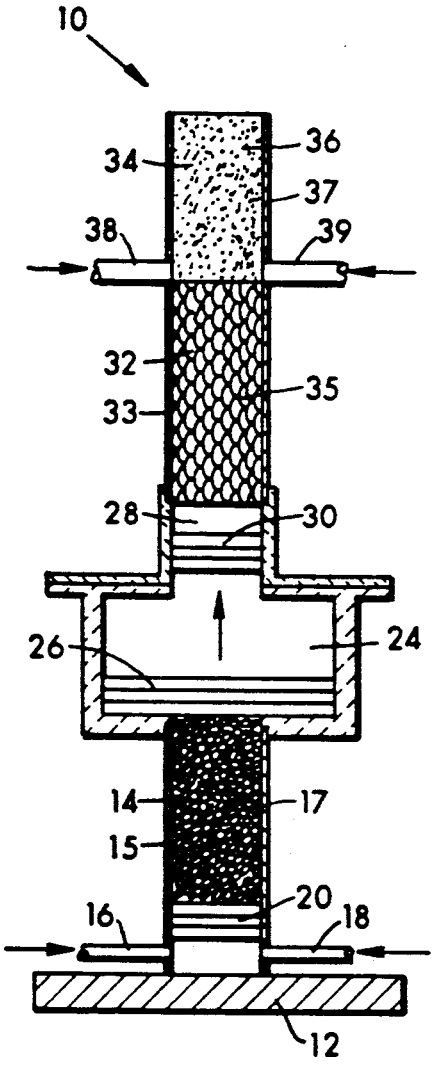
FIG. 1 is a longitudinal sectional view, highly schematic in nature, of a first embodiment of combustion apparatus in accordance with the present invention, which embodiment is based upon use of two combustion stages.

Referring to the drawings, and particularly to FIG. 1, combustion apparatus or a combustor embodying features of the invention, is designated generally by the reference numeral 10. Combustor 10 conveniently has a base 12 which may be of metal, such as steel. Seated upon base 12 is a hollow vertical column 14, the interior of which defines a conduit 15. Near base 12, a fuel inlet 16 and an oxidizer, e.g., air inlet 18 are provided, which open into conduit 15. Above inlets 16 and 18 there is disposed in conduit 15 a flow straightener 20, conveniently in the form of a ceramic honeycomb. Above the flow straightener 20, the conduit 15 is filled with glass beads 17 to ensure intimate mixing of the fuel and air in the proportions fed. The conduit 15 discharges into a plenum 24, containing another flow straightener 26, suitably in the form of a ceramic honeycomb. Plenum 24 communicates with a conduit 28 containing a ceramic honeycomb or like flow straightener 30.

Conduit 28 leads to a first combustion zone 32, which is defined within the tubular non-porous wall 33 (e.g. comprising a ceramic or other material capable of withstanding high temperatures), and is filled with a porous matrix (PM) 35. Typical examples of compositions suitable for the porous matrix are ceramic foams such as reticulated silica-alumina foam and zirconia foam; and packed beds, such as beds of saddles, balls, rods, and the like; or other formulations with low pressure drop and capable of withstanding the temperatures typically present in combustion apparatus. Foams utilizable in the invention include the silica-alumina partially stabilized zirconia, silicon nitride, and silicon carbide foams of High Tech Ceramics, characterized as having about 5-65 pores/inch (ppi). Other porous matrix materials and configurations may similarly be employed.

The flow of the combustion products from first combustion zone 32, is seen to be provided to a second combustion zone 34, defined within the tubular non-porous wall 37. Zone 34 is also filled with a porous matrix 36, which can be the same or different from the matrix 35 in zone 32. Between first combustion zone 32 and second combustion zone 34, inlets 38 and 39 are provided, for feeding additional fuel and oxygen-containing gas, e.g., air. The outer surfaces of walls 33 and 37 are non-porous and provide the source of radiant heat transfer with no burning on the walls' surfaces.

In operation of the two-stage embodiment of FIG. 1, the fuel and oxygen-containing gas to be fed are mixed by conventional mixing means to provide a mixture containing oxygen which is present in 60 to 95%, typically 85% of the stoichiometric amount for the fuel, so that the mixture is a "rich" mixture. The mixture typically has a temperature of 40° to 80° F., typically about 300° K. (80° F.) as it passes through the mixing media 17. In first combustion zone 32 the mixture of fuel and oxygen-containing gas is ignited, and combustion takes place at a temperature of 2000° to 2800° F.

After the fuel-rich mixture has been combusted in zone 32, additional fuel and oxygen-containing gas mixed by conventional mixing means (not shown) are added to it to produce a "lean" mixture wherein the oxygen present is 105 to 125%, typically 110% of the stoichiometric quantity, and the augmented lean mixture is combusted in the second combustion zone 34 at a temperature of 1800° to 2600° F., typically about 2200° F.

This temperature range is low enough to prevent the formation of oxides of a nitrogen either by "thermal" or "prompt" reaction mechanisms. Control of this temperature range is accomplished by the combined effects of fuel-air staging and of radiant heat transfer from the surface of the porous media.

In this operation, a portion of the combustion air and/or fuel bypasses the initial premix of fuel and air in the interior of the PM first combustion zone. Ignition and combustion of the initial mixture occurs under fuel rich conditions as a result of preheat generated by radiant feedback. Peak flame temperature occurs in this reducing zone as a result of radiant and convective preheat with minimum $NO_x$ formation. The air and/or fuel which is bypassed is the mixed with the products formed in the first combustion zone to oxidize the excess combustibles, prior to exiting the PM burner. The cooling effect of the radiant heat transfer from the PM burner results in a lower temperature than the theoretical flame temperature for the total combined fuel/air mixture in the second zone which is overall oxidizing. This combined effect results in lower $NO_x$ levels being achieved than would be possible for either a single staged or multiple staged burner employing diffusion burning.

In consequence, significant improvement in terms of $NO_x$ reduction is achieved vis-a-vis passage of all of the fuel and all of the oxygen through a single combustion zone, such as zone 32. Typically, e.g., a reduction of from 50 to 80% is achieved compared to a standard diffusion flame burner or a single stage premix burner wherein combustion occurs either in the mixture or on the surface.

In a preferred embodiment of the present invention, combustion also occurs in an additional combustion zone—which is upstream of the fuel-rich zone. A combustor embodiment for carrying out the preferred process is thus shown in FIG. 2, wherein parts corresponding to parts shown in FIG. 1 are given the same reference numerals, to which, however, 100 has been added.

Figure 2:
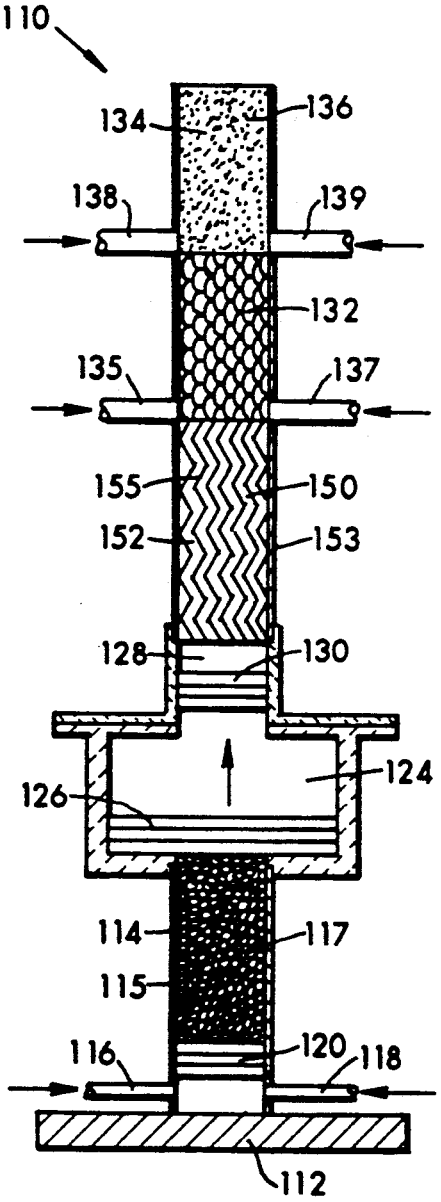
FIG. 2 is a schematic sectional view similar to FIG. 1, of another embodiment of the combustion apparatus of the invention, which is based on use of three combustion stages.

Thus, referring to FIG. 2, the combustor 110 includes fuel-rich and lean burn combustion zones 132 and 134. However, there is now provided upstream of and preceding chamber 132, an additional lean burn stage 150. This is defined by the chamber or zone 152 within non-porous tubular wall 153. Fuel and air enter inlet conduit 115 via inlets 116 and 118 and flow straightener 120, and are mixed with the aid of glass beads 117 or other mixing means. After passing through flow straightener 126 and plenum 124, the mixture, which is appropriate for lean burning conditions, proceeds via flow straightener and flashback arrestor 130 and conduit 128 to zone 152. Combustion zone 152 is provided with a porous matrix 155—preferably ceramic or other material as previously described for the combustion zones in the FIG. 1 apparatus.

In operation of the preferred process and apparatus, e.g., in the embodiment of FIG. 2, the first combustion stage at zone 152, will be operated as a lean stage, i.e., the mixture fed to it will be a lean mixture in which the oxygen will be present in the mixture in 150 to 250% of the stoichiometric quantity. This zone is operated at a temperature of 1500° to 2500° F., typically 2000° F. Additional fuel and air are added via inlets 135 and 137, and the second combustion stage at zone 132 will be operated as a fuel-rich zone, i.e., the oxygen will be present in the mixture in 60 to 95% of the stoichiometric amount. The second combustion stage is at a temperature of 1000° to 2000° F., typically about 1800° F. The effluent mixture from the second combustion stage has added to it additional fuel and oxygen-containing gas, e.g., air, via inlets 138 and 139 to provide a lean mixture wherein the oxygen is present in 105 to 125% of the stoichiometric amount. This lean mixture is provided into the third combustion stage i.e. at zone 134 wherein combustion takes place in zone 156 at a temperature of 1000° to 2000° F., typically around 1800° F. Zone 134 is provided with a porous matrix 136 similar to matrix 36 in FIG. 1, e.g., comprising a ceramic foam or the like.

Thus in the preferred process and apparatus of FIG. 2, sufficient fuel mixes with the air in the first (lean) stage of apparatus 110 to provide for a combustion temperature in zone 152 below 1800° K. (2800° F.), to minimize thermal $NO_x$. In this stage, the residence time is minimized to convert fuel to CO but not totally to $CO_2$. In the second stage, i.e., at zone 132, the remainder of the fuel is added to obtain additional heat release, but again at a temperature below 1800° K. (2800° F.). Prompt $NO_x$ formation will be retarded because radicals from the first stage will attack the fresh fuel and energy will be rapidly released from the oxidation of CO. In the third stage, i.e., at combustion zone 134, sufficient air and/or fuel is added to complete overall heat release.

It will be understood that various changes and modifications may be made in the embodiments described and illustrated without departing from the invention as defined in the appended claims. Thus, for example, in FIGS. 1 and 2, the tubular walls within which the successive zones are defined are shown as comprising separate pieces. In practice it is possible for the two or three zones to be defined at successive portions interior to a single tube, with the porous matrix being the same throughout the length of the tube, or of differing composition and/or density at each of the several zones. It is intended, therefore, that all matter contained in the foregoing description and in the drawings shall be interpreted as illustrative only, and not in a limiting sense.

What is claimed is:

1. A method of low $NO_x$ combustion which comprises mixing fuel and a source of oxygen and combusting said mixture in three successive zones, including a first zone wherein the mixture is fuel-lean, a second zone for receiving the combustion products of the first zone and wherein the mixture is adjusted to be fuel-rich; and a third zone for receiving the combustion products of the second zone and wherein the mixture is adjusted to again be fuel-lean; each of said three zones being filled with a porous matrix the void spaces of which provide sites at which substantially all of the said combustion occurs.

2. A method as defined in claim 1, wherein said porous matrix comprises a zirconia foam.

3. A method as defined in claim 1, wherein said porous matrix comprise a silica-alumina foam.

4. A method as defined in claim 1, wherein said porous matrix comprise a packed bed.

5. A method in accordance with claim 4, wherein said packed bed comprises discrete media, the interspaces of which define said voids.

6. A method in accordance with claim 5, wherein said media comprises balls.

7. A method in accordance with claim 5, wherein said media comprises saddles.

8. A method in accordance with claim 5, wherein said media comprises rods.

9. Apparatus for low $NO_x$ combustion comprising first, second and third successive combustion zones each filled with a porous high-temperature resistant matrix, the void spaces of which provide sites at which substantially all of the said combustion occurs; means to provide an initial mixture of fuel and air to said first zone and to adjust the air-fuel ratio to create lean combustion conditions therein; means for feeding the combustion products from said first zone to said second zone and mixing therewith fuel and oxygen to establish fuel-rich conditions therein; and means for feeding the combustion products from said second zone to said third zone and augmenting same with further fuel and sufficient additional oxygen to create lean burning conditions therein to complete the oxidation of the products from said second zone.

10. Apparatus in accordance with claim 9, wherein the porous matrix present in at least one said zone comprises a zirconia foam.

11. Apparatus in accordance with claim 9 wherein the porous matrix present in at least one said zone comprises a silica-alumina foam.

12. Apparatus in accordance with claim 9, wherein a porous matrix present in at least one said zone comprises a packed bed.

13. Apparatus is accordance with claim 12, wherein said packed bed comprises discrete media, the interspaces of which define said voids.

14. Apparatus in accordance with claim 13, wherein said media comprises balls.

15. Apparatus in accordance with claim 9, wherein differing matrices are used at successive of said zones.

* * * * *